US005649742A

United States Patent [19]

Liu

[11] Patent Number: 5,649,742

[45] Date of Patent: Jul. 22, 1997

[54] LEG ASSEMBLY FOR CHAIRS

[76] Inventor: Clement Liu, No. 56-3, Kan Tung Tsun, Kuei Jen Hsiang, Tainan Hsian, Taiwan

[21] Appl. No.: 681,347

[22] Filed: Jul. 23, 1996

[51] Int. Cl.[6] ..... A47C 7/02

[52] U.S. Cl. ..... 297/452.2; 297/440.24; 297/440.22; 297/448.1; 297/447.3; 297/446.1

[58] Field of Search ..... 297/440.23, 440.24, 297/440.1, 440.2, 440.22, 445.1, 448.1, 449.1, 452.2, 447.3, 446.1

[56] References Cited

U.S. PATENT DOCUMENTS

| | | | |
|---|---|---|---|
| 3,301,597 | 1/1967 | Bereday | 297/440.23 X |
| 3,799,611 | 3/1974 | Steinfeld | 297/440.23 |
| 4,522,444 | 6/1985 | Pollock | 297/440.24 X |
| 4,588,227 | 5/1986 | Austin | 297/440.23 X |
| 4,784,436 | 11/1988 | Sutherland | 297/440.24 |
| 5,407,250 | 4/1995 | Prince et al. | 297/440.23 X |
| 5,498,054 | 3/1996 | Tomlinson | 297/440.24 X |

FOREIGN PATENT DOCUMENTS

| | | | |
|---|---|---|---|
| 1065990 | 6/1954 | France | 297/440.23 |
| 376251 | 7/1932 | United Kingdom | 297/440.23 |

*Primary Examiner*—Milton Nelson, Jr.

*Attorney, Agent, or Firm*—Morton J. Rosenberg; David I. Klein

[57] ABSTRACT

A leg assembly for a chair includes four legs, a pair of lateral beams each interconnected between two of the four legs, and a pair of transverse beams interconnected between the lateral beams. A seat cushion is mounted on the transverse beams and has a plurality of nuts attached to an underside thereof. Each lateral beam includes two spaced tubes extending therefrom toward the other lateral beam, each tube having a first transverse bore defined therethrough. Each transverse beam includes two reduced ends each having a second transverse bore defined therethrough. The reduced ends of each transverse beam are respectively received in two aligned tubes respectively on the lateral beams, and a plurality of bolts are extended through the aligned first and second bores and then engaged with the associated nuts mounted on the seat cushion.

2 Claims, 6 Drawing Sheets

LEG ASSEMBLY FOR CHAIRS

BACKGROUND OF THE INVENTION

1. Field of the Invention

The present invention relates to an improved leg assembly for chairs.

2. Description of the Related Art

Chairs are used everyday and a typical one thereof is shown in FIG. 5 of the drawings. A leg assembly of the chair in FIG. 5 includes four legs 71, a pair of lateral beams 72 each interconnected between two of the four legs 71, and a pair of transverse beams 73 interconnected between the lateral beams 72. Generally, the legs 71, the lateral beams 72, and the transverse beams 73 are welded to form an integral unit and then processed with surface treatments for subsequent assembly of a backrest and a seat cushion, resulting in a bulky chair which is very inconvenient for storage and transportation. The bulky chair further results in an increase in the transportation cost as the legs cannot be dismantled.

FIG. 6 illustrates another conventional leg assembly which includes four legs 80, a pair of lateral beams 81 each interconnected between two of the four legs 80, and a pair of transverse beams 82 interconnected between the lateral beams 81. Each lateral beam 81 includes two receptacles 811 each for receiving an end of the associated transverse beam 82. Each lateral beam 81 further includes an aperture 812 defined therein in alignment with each receptacle 811. A bolt 813 is extended through each aperture 812, the associated receptacle 811, and then engaged with a nut 821 mounted between the associated end of the corresponding transverse beam 82. However, the leg assembly requires two sizes of steel tubes for manufacturing the transverse beams 82 and the lateral beams 81 having a diameter greater than that of the transverse beams 82, which is a burden in cost and which causes management inconvenience of material. In addition, assemblage of the transverse beams 82 to the lateral beams 81 requires bolts 813 and nuts 821 and is time-consuming, while the bolts 813 are exposed outside the lateral beams 81 after assembly and thus adversely affect the overall aesthetic effect of the chair.

Therefore, there has been a long and unfulfilled need for an improved leg assembly for chairs to mitigate and/or obviate the above problems.

SUMMARY OF THE INVENTION

In accordance with one aspect of the invention, a leg assembly for a chair includes four legs, a pair of lateral beams each interconnected between two of the four legs, and a pair of transverse beams interconnected between the lateral beams. A seat cushion is mounted on the transverse beams and has a plurality of nuts attached to an underside thereof. Each lateral beam includes two spaced tubes extending therefrom toward the other lateral beam, each tube having a first transverse bore defined therethrough. Each transverse beam includes two reduced ends each having a second transverse bore defined therethrough. The reduced ends of each transverse beam are respectively received in two aligned tubes respectively on the lateral beams, and a plurality of bolts are extended through the aligned first and second bores and then engaged with the associated nuts mounted on the seat cushion.

In accordance with a further aspect of the invention, a leg assembly for a chair includes four legs, a pair of lateral beams each interconnected between two of the four legs, and a pair of transverse beams interconnected between the lateral beams. A seat cushion is mounted on the transverse beams and has a plurality of nuts attached to an underside thereof. Each lateral beam includes two spaced tubes extending therefrom toward the other lateral beam, each tube having a reduced distal end with a first transverse bore defined therethrough. Each transverse beam includes two ends each having a second transverse bore defined therethrough. The distal ends of two aligned tubes respectively on two opposed lateral beams are respectively received in two ends of an associated transverse beam, and a plurality of bolts are extended through the aligned first and second bores and then engaged with the associated nuts mounted to the seat cushion.

Other objects, advantages, and novel features of the invention will become more apparent from the following detailed description when taken in conjunction with the accompanying drawings.

DESCRIPTION OF THE PREFERRED EMBODIMENT

Figure 1:
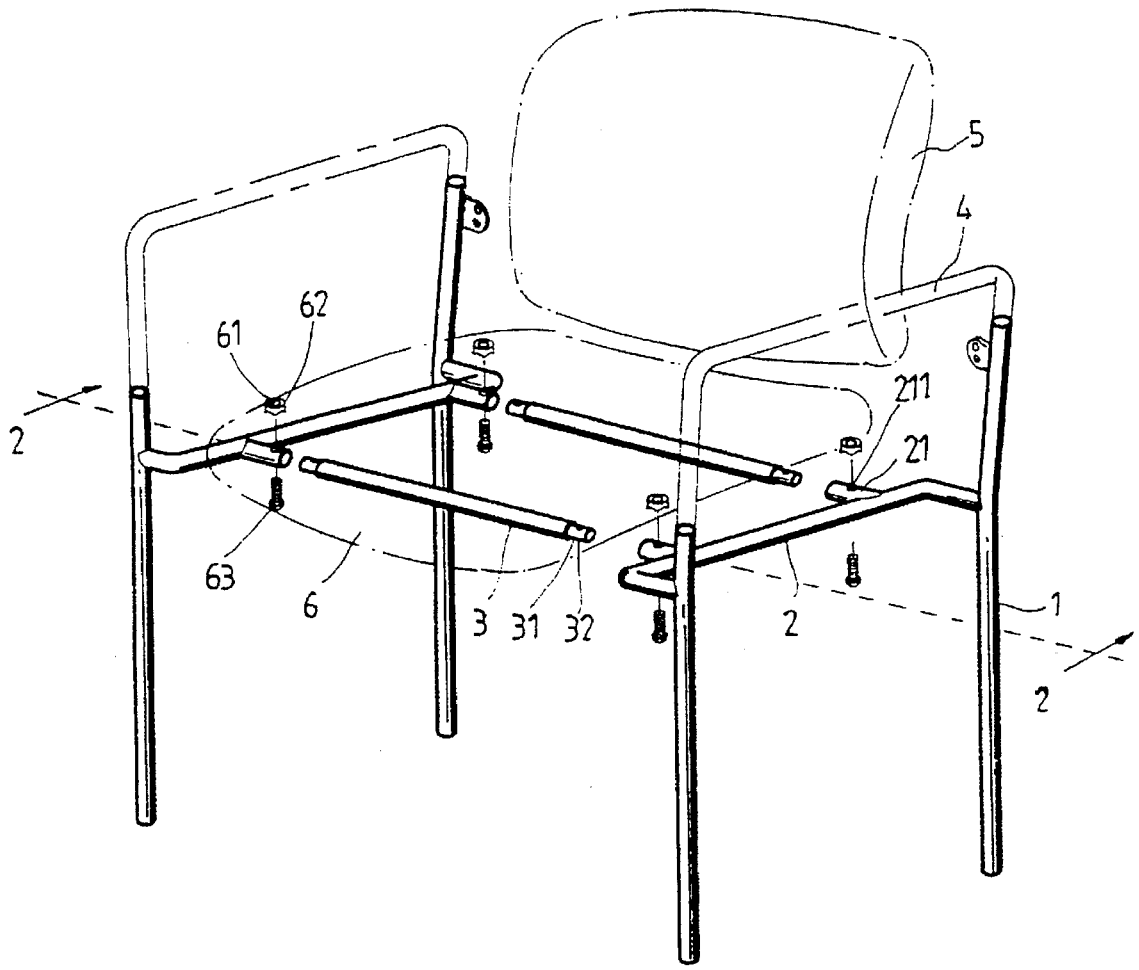
FIG. 1 is a partially-exploded perspective view of a leg assembly for chairs in accordance with the present invention.
Figure 2:
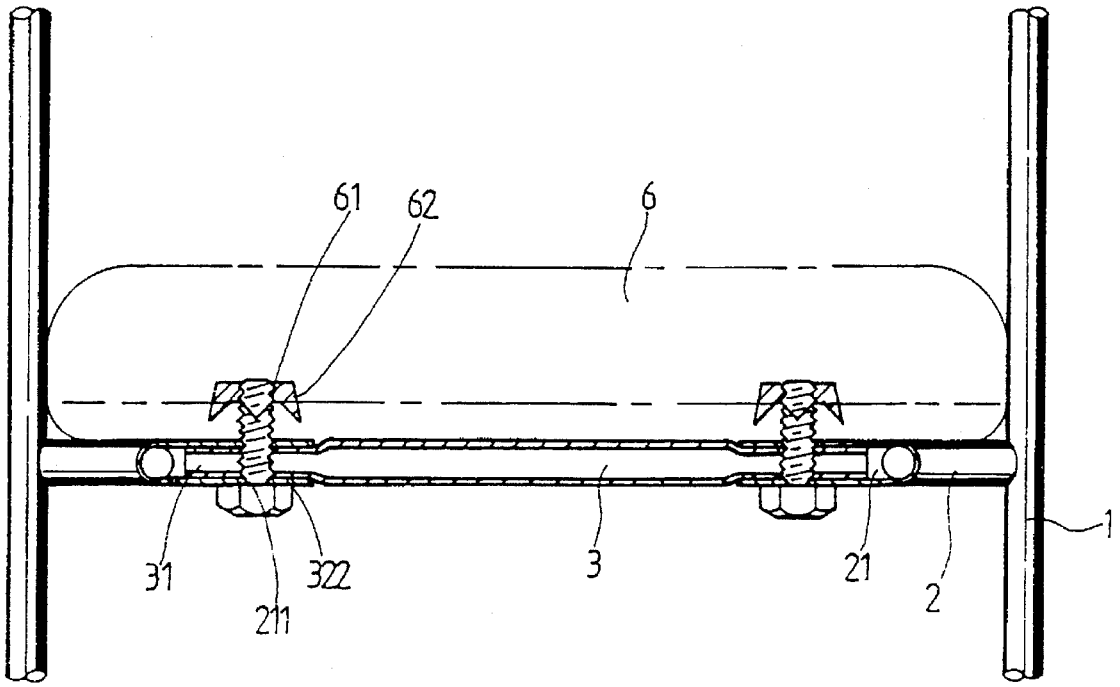
FIG. 2 is a partial cross-sectional view of the leg assembly taken along the section line 2—2 of FIG. 1.

Referring to the FIGS. 1 and 2, a leg assembly in accordance with the present invention generally includes four legs 1, a pair of lateral beams 2 each interconnected between two of the four legs i, and a pair of transverse beams 3 interconnected between the lateral beams 2. Two armrests 4 and a backrest 5 may be mounted to the two pairs of legs 1, and a seat cushion 6 can be mounted to the transverse beams 3, which are conventional and therefore not further described.

Each lateral beam 2 includes two spaced tubes 21 extending therefrom toward the other lateral beam 2, each tube 21 having a first transverse bore 211 defined therethrough. Each transverse beam 3 includes two reduced ends 31 each having a second transverse bore 32 defined therethrough. The reduced ends 31 of each transverse beam 3 are respectively received in two aligned tubes 21 respectively on the two opposed transverse beams 2, and a plurality of bolts 63 are extended through the aligned first and second bores 211 and 32 and then engaged with screw holes 62 of associated nuts 61 mounted to an underside of the seat cushion 6, thereby mounting the transverse beams 3 to the lateral beams 2 as well as mounting the seat cushion 6 to the transverse beams 3.

Figure 3:
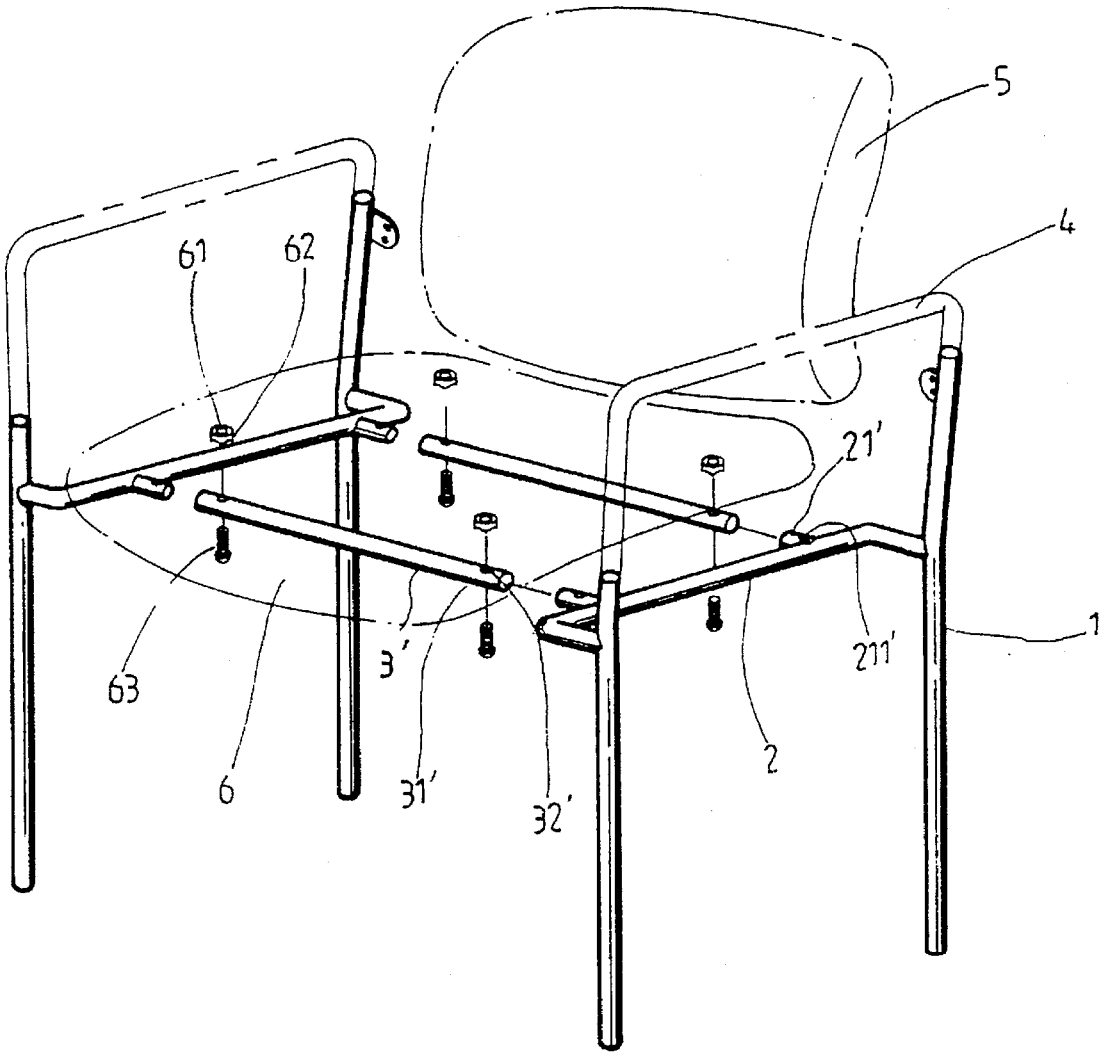
FIG. 3 is a partially-exploded perspective view of an embodiment of the leg assembly for chairs in accordance with the present invention.
Figure 4:
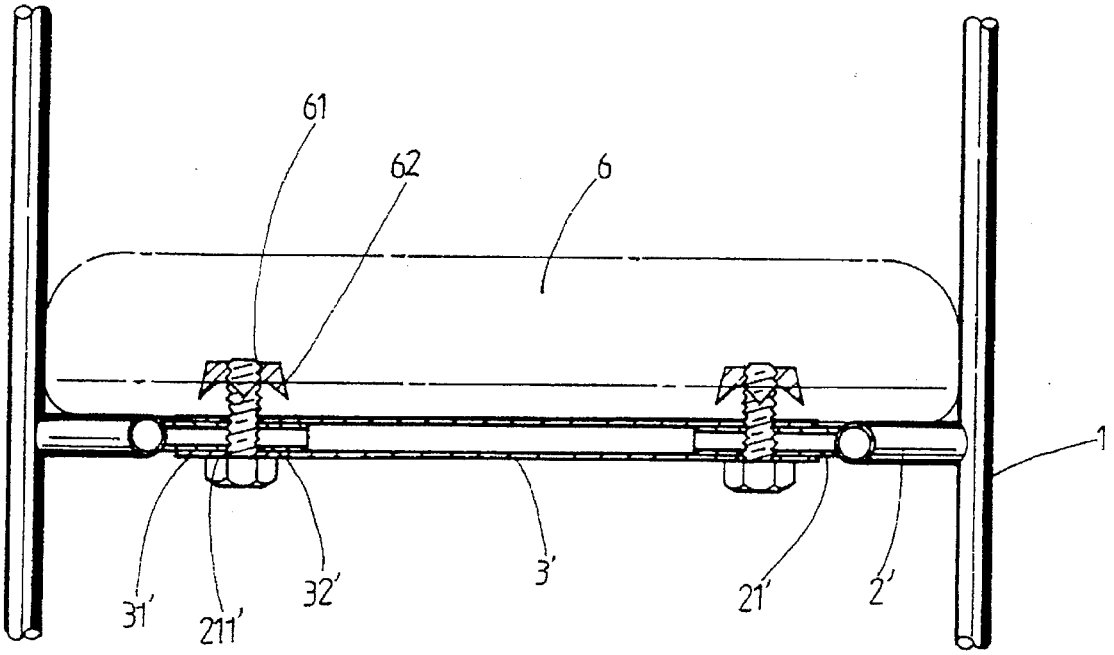
FIG. 4 is a partial cross-sectional view of the leg assembly taken along the Section Line 4—4 of FIG. 3.
Figure 5:
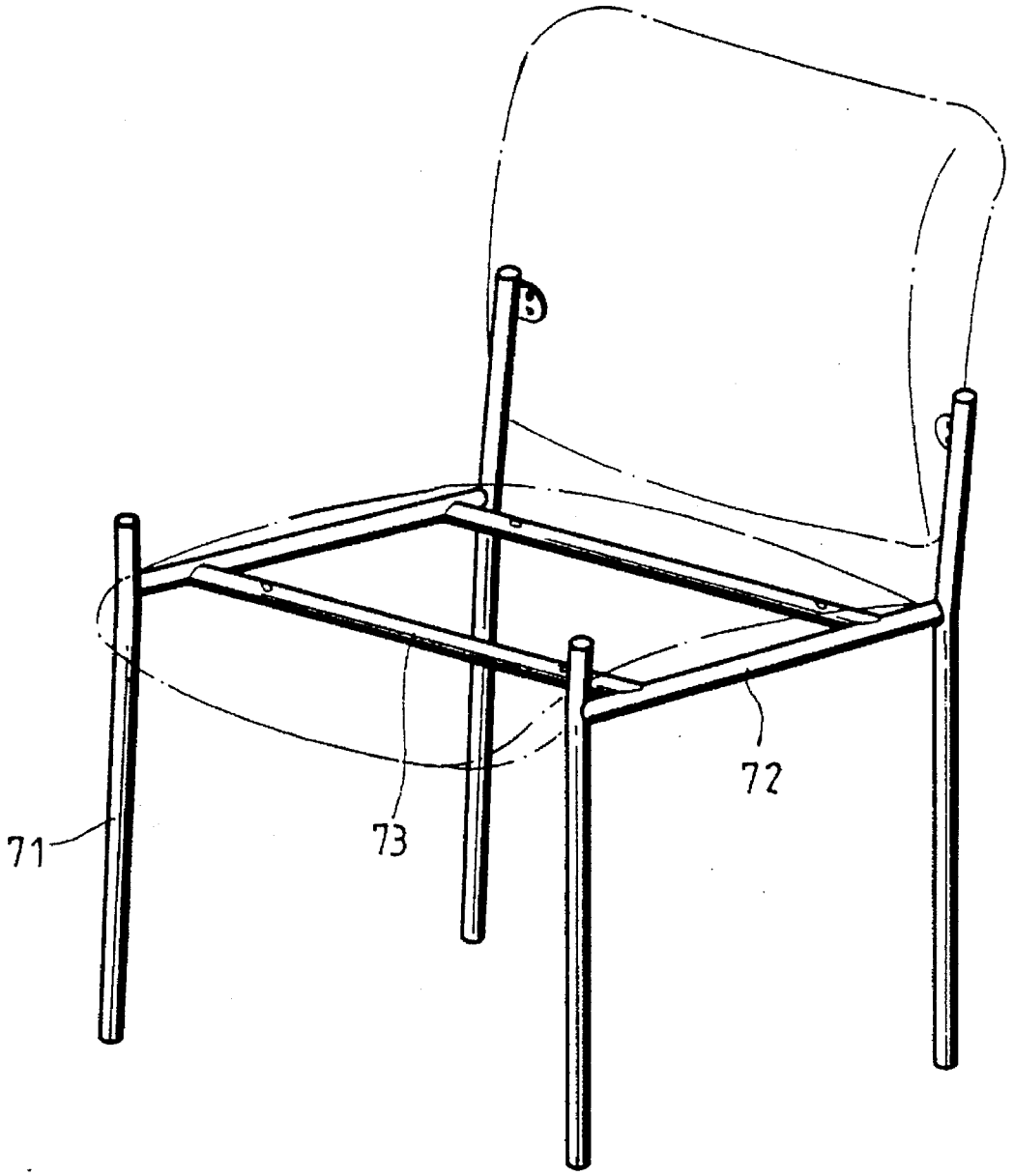
FIG. 5 PRIOR ART
FIG. 5 is a schematic perspective view illustrating a assembly in accordance with the present invention; conventional leg assembly for chairs.
Figure 6:
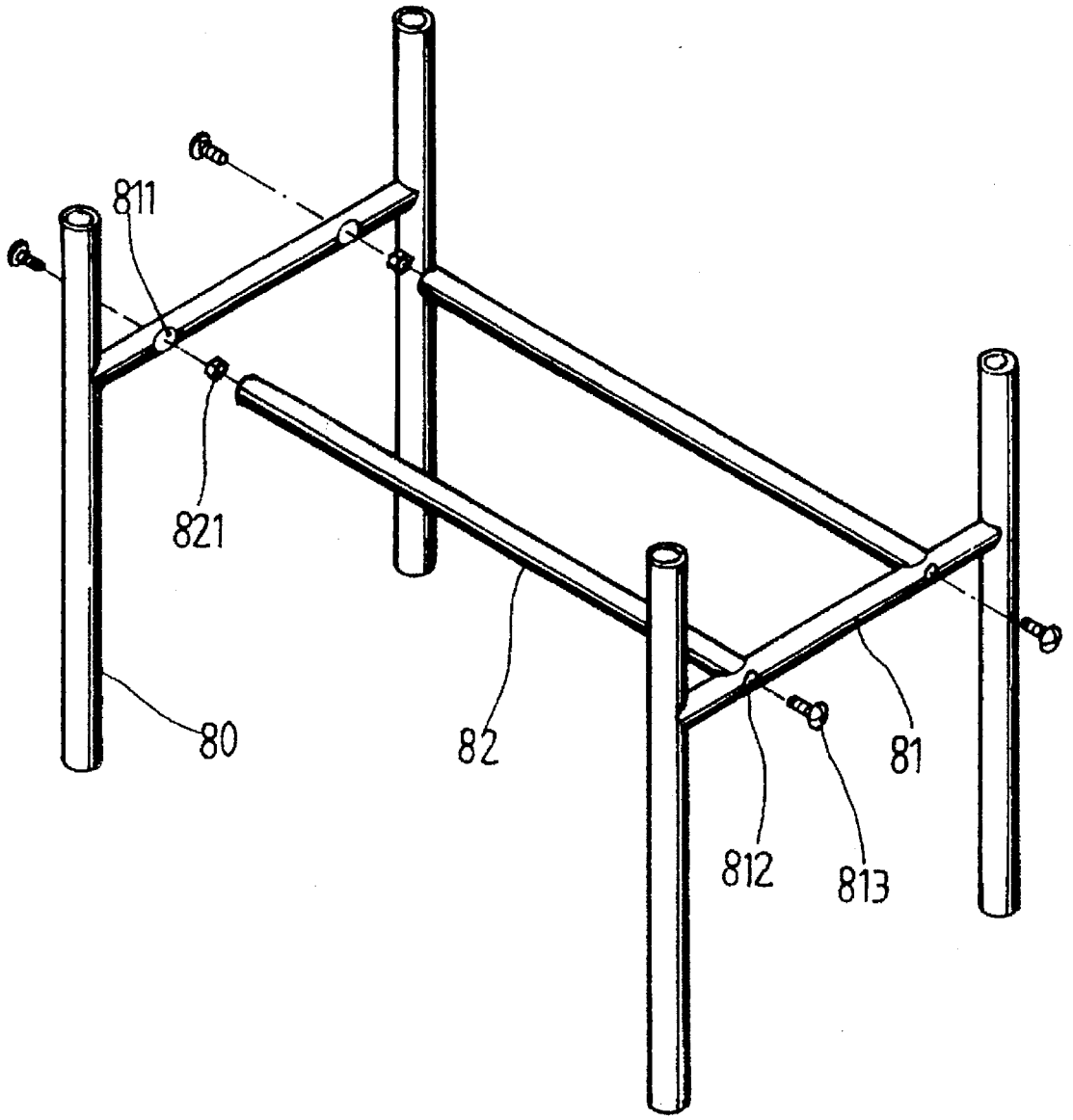
FIG . 6 PRIOR ART
FIG. 6 is a schematic perspective view illustrating another conventional leg assembly for chairs.

Alternatively, as shown in FIGS. 3 and 4 each tube 21' on the lateral beams 2' may include a reduced distal end, while the ends 31' of the transverse beams 3' are not reduced in diameter for receiving the reduced distal ends of the associated tubes 21' without affecting the engagement therebetween.

Conclusively, it is appreciated that the leg assembly in accordance with the present invention includes the following advantages:

(1) the leg assembly is detachable and thus requires a smaller storage space which is advantageous for shipment and transportation and saves transportation cost;

(2) the legs 1, the lateral beams 2, and the transverse beams 3 can be formed by steel tubes of identical diameters, which has a low cost for assemblage and is convenient in material management;

(3) the lateral beams 2, the transverse beams 3, and the seat cushion 6 are assembled together by a single procedure; and (4) the bolts 63 are mounted under the seat cushion 6 and thus provides an increased aesthetic effect for the chair.

Although the invention has been explained in relation to its preferred embodiment, it is to be understood that many other possible modifications and variations can be made without departing from the spirit and scope of the invention as hereinafter claimed.

What is claimed is:

1. A leg assembly for a chair, comprising:

four legs, a pair of lateral beams each interconnected between two of said four legs, and a pair of transverse beams interconnected between said lateral beams, a seat cushion being mounted on said transverse beams and having a plurality of nuts attached to an underside thereof, each said lateral beam including two spaced tubes extending therefrom toward the other said lateral beam, each said tube having a first transverse bore defined therethrough, each said transverse beam including two reduced ends each having a second transverse bore defined therethrough, said reduced ends of each said transverse beam being respectively received in two aligned said tubes respectively on said lateral beams, and a plurality of bolts being extended through the aligned said first and second bores and then engaged with the associated said nuts mounted on said seat cushion.

2. A leg assembly for a chair, comprising:

four legs, a pair of lateral beams each interconnected between two of said four legs, and a pair of transverse beams interconnected between said lateral beams, a seat cushion being mounted on said transverse beams and having a plurality of nuts attached to an underside thereof, each said lateral beam including two spaced tubes extending therefrom toward the other said lateral beam, each said tube having a reduced distal end with a first transverse bore defined therethrough, each said transverse beam including two ends, each having a second transverse bore defined therethrough, said reduced distal ends of two aligned said tubes respectively on two opposed said lateral beams being respectively received in said two ends of an associated said transverse beam, and a plurality of bolts being extended through the aligned said first and second bores and then engaged with the associated said nuts mounted to said seat cushion.

* * * * *